United States Patent [19]

Matranga et al.

[11] 4,135,526

[45] Jan. 23, 1979

[54] APPLICATION OF FINGERNAL EXTENSION TO NATURAL FINGERNAIL

[75] Inventors: Eve Matranga, West Los Angeles; Yosh Hokama, Torrance, both of Calif.

[73] Assignee: International Beauty Distributor, Gardena, Calif.

[21] Appl. No.: 831,806

[22] Filed: Sep. 9, 1977

[51] Int. Cl.[2] ..... A45D 29/00

[52] U.S. Cl. ..... 132/73

[58] Field of Search ..... 132/73, 88.7, 88.5, 132/1

[56] References Cited

U.S. PATENT DOCUMENTS

| | | | |
|---|---|---|---|
| 2,073,867 | 3/1937 | Feigenbaum | 132/73 |
| 3,037,514 | 6/1962 | Lappe | 132/88.7 X |
| 3,750,684 | 8/1973 | Russell | 132/88.5 |
| 4,007,748 | 2/1977 | Matranga | 132/73 |

*Primary Examiner*—G. E. McNeill

*Attorney, Agent, or Firm*—William W. Haefliger

[57] ABSTRACT

An artificial fingernail is formed to have a stop abutting the convex forward edge of a natural fingernail, and to be securely bonded to the latter at edge overlap locations.

1 Claim, 9 Drawing Figures

APPLICATION OF FINGERNAL EXTENSION TO NATURAL FINGERNAIL

BACKGROUND OF THE INVENTION

This invention relates generally to the application and retention of artificial fingernails to natural fingernails; more specifically, it concerns a simple and rapid method of attaching artificial nails characterized by the elimination of many prior problems and disadvantages.

It has been conventional practice to adhesively attach artificial fingernails directly onto the upper exposed surfaces of natural fingernails. This method not only risks damage to the natural nails as through promotion of fungus growth at the interface between the nails, but it also requires considerable time and effort and often results in an unsightly, cumbersome and/or fake appearance.

SUMMARY OF THE INVENTION

It is a major object of the invention to provide an improved method of attaching an artificial fingernail to a natural fingernail. The artificial nail has a rearward edge, typically concave, and forms a recess conforming generally to the shape of the forward convex edge of the natural nail, and it also has a stop at its underside surface and in spaced relation to the rearward edge. The method includes the steps:

(a) applying a quick drying liquid adhesive to an underside portion of the artificial fingernail proximate the stop and rearward edge, and (b) effecting proximal abutting contact of the stop with the natural fingernail forward edge and retaining the underside portion of the artificial nail against an upper surface portion of the natural nail to allow the adhesive to effect said attachment.

Accordingly, rapid and accurate positioning of the artificial nail on the natural nail is achieved in a simple and direct manner, to achieve minimum edge overlap for bonding.

As will be seen, the retaining step is typically effected by holding a reduced thickness strip portion of the artificial nail to upper surface extent of the natural nail, to effect a desired adhesive bond. This step is enhanced by the shape of the artificial nail which typically forms two laterally spaced cusps toward which the crescent shaped stop extremities extend, the strip typically being carried to extend over the space between the cusps, i.e. in position to be pressed downwardly onto the natural nail between the cusps.

These and other objects and advantages of the invention, as well as the details of an illustrative embodiment, will be more fully understood from the following description and drawings, in which:

DRAWING DESCRIPTION

DETAILED DESCRIPTION

Figure 1:
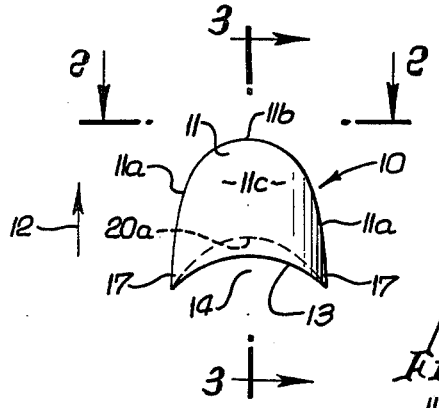
FIG. 1 is a top plan view of an artificial nail incorporating the invention.
Figure 2:
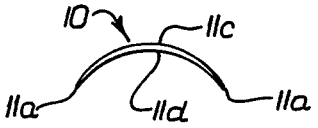
FIG. 2 is an end view on lines 2—2 of FIG. 1.
Figure 3:
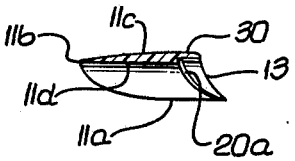
FIG. 3 is a section on lines 3—3 of FIG. 1.

In the drawings, an artificial nail 10 in accordance with the invention has a body 11 which is longitudinal elongated and transversely upwardly convex. The opposite sides **11*a* of the nail body taper forwardly in the direction of arrow 12 and the body is rounded at its forwardmost edge 11*b*. Preferably, but not necessarily, the body convex upper surface 11*c* tapers toward the body concave lower surface 11*d*, as is clear from FIGS. 2 and 3, whereby the forward edge 11*b* is typically sharp. Also, the body lateral edges 11*a*** are typically sharp.

Figure 5:
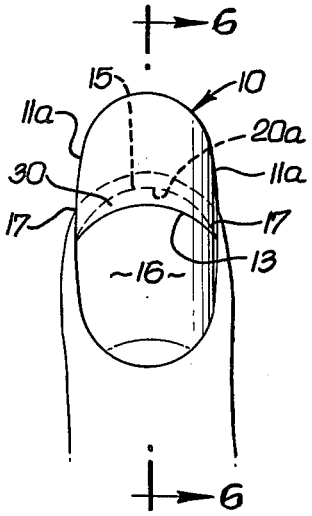
FIG. 5 is a top plan view showing application of the artificial nail to a natural fingernail.

The body 11 has a generally concave rearward peripheral distal edge 13 forming a recess 14 to expose the main body of the natural (as for example human) fingernail 16, as better seen in FIG. 5. Accordingly, the body 11 forms two laterally spaced, rearwardly projecting cusps 17 at the points or locations where the lateral sides **11*a* meet the lateral extremities of the concave edge 13. The body 11** may consist of an acetate type or other flexible plastic material, and for best results the body maximum thickness lies between about 0.005 and 0.025 inches.

It will be noted that the molded plastic body has a stop shoulder or step **20*a* at the proximal underside juncture of the main extent of the nail with a reduced thickness strip portion 30 of the nail. The stop or step is preferably located forwardly of edge 13 and has crescent shape, with lateral extremities which approach and terminate at the cusps 13. The shoulder 20*a* is forwardly spaced from rearward edge 13 at a maximum distance indicated at "t", proximate the medial longitudinal axis 21** of the body.

Figure 4:
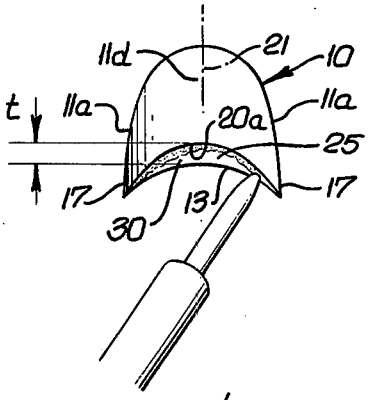
FIG. 4 is a bottom plan view of the FIG. 1 nail, showing liquid adhesive application.
Figure 6:
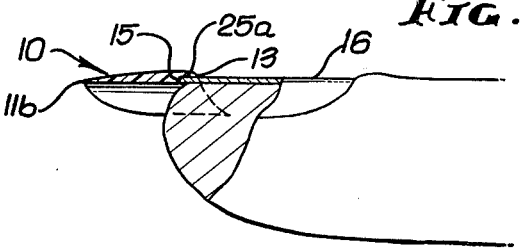
FIG. 6 is a section on lines 6—6 of FIG. 5.

Referring now to the method of attaching the thus provided artificial fingernail 10 to the natural nail 16, an abutting contact is effected between the stop shoulder **20*a* with the forward edge 15 of the natural nail, as seen in FIGS. 5 and 6. Preliminarily, the natural fingernail 16 may be trimmed as by scissors to provide and conform the blunt edge 15 thereof to the natural shape of edge 13; however, an exact match is not required. Also, a quick drying liquid adhesive is applied to an underside crescent shaped arc portion (designated at 25) of the artificial nail, near stop 20*a* and edge 13**, as seen in bottom plan view FIG. 4.

When the abutting contact is made as described, the liquid adhesive on crescent 25 is underlapped by a corresponding crescent shaped upper surface edge portion **25*a*** of the natural fingernail, as seen in FIG. 6. Upon quick drying of the adhesive, the two narrow crescent shaped portions are firmly bonded together, and the main surface extent of the natural nail is not contacted by the liquid adhesive, or covered by the plastic nail, preserving the health of said main surface of the natural nail.

The crescent shaped portions of the two nails are retained together for the short period of time required for spreading and quick drying of the adhesive. For this purpose, cusps 17 are pressed down on the natural nail. After a few seconds, the artificial fingernail is completely and durably secured to the natural fingernail forward blunt edge 15. One unusually advantageous adhesive is that sold under the trademark "CRAZY GLUE", a product of Toagosei Chemical Company, Tokyo, Japan. It is otherwise known as an alpha cyanoacrylate, and is capable of curing or drying in air in about 4–6 seconds.

Figure 7:
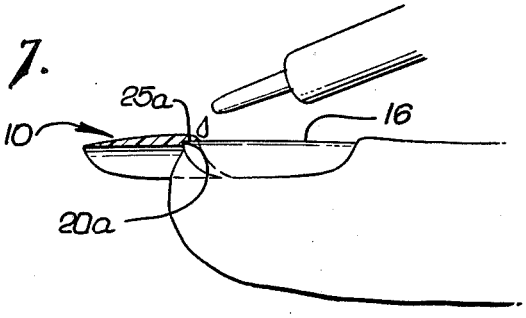
FIGS. 7 and 8 are views like FIG. 6.
Figure 8:
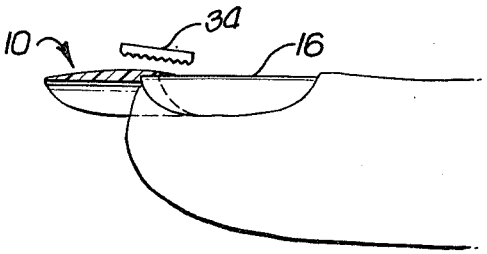
Figure 9:
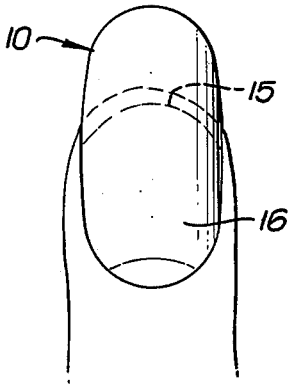
FIG. 9 is a top plan view of the final combination.

Additional adhesive may be applied to the rearward edge 13 and to edge 15 (see FIG. 7) to strengthen the bonded attachment. Finally, the upper surface of the artificial nail adjacent edge 13 may be filed or buffed (see tool 34 in FIG. 8) to smooth the junction with nail 16. The final combination appears in FIG. 9.

We claim:

1. An artificial fingernail attachable to a natural fingernail having a forward generally convex edge, said artificial fingernail comprising (a) a thin plastic sheet element sized to provide a forward extension of the natural fingernail, said element extending generally horizontally, (b) said element having a rearwardly concave crescent shaped distal edge and forming a recess below said edge to receive and conform generally to the shape of the convex forward edges of the natural fingernail;

(c) there being a rearwardly concave crescent shaped stop at the proximal underside of the artificial fingernail in spaced relation to said rearward distal edge, the stop extending everywhere vertically and located to abut the natural fingernail forward edge to position the artificial fingernail so that an underside portion of the artificial fingernail may overlap and be bonded to an upper surface portion of the natural nail, (d) the artificial fingernail including two rearwardly projecting cusps toward which extremities of both said crescent shaped, rearward distal edge and said crescent shaped stop extend in generally rearwardly directions, the curvature of said crescent shaped rearward distal edge being lesser than the curvature of said crescent shaped stop, the stop spaced forwardly of said distal edge at a distance which becomes a maximum proximate a forwardly extending medial axis defined by the sheet element, said maximum distance being substantially less than the forward dimension from either cusp to a plane normal to said axis and tangent to said stop.

* * * * *